US008042440B2

(12) United States Patent
Osumi

(10) Patent No.: US 8,042,440 B2
(45) Date of Patent: Oct. 25, 2011

(54) PUNCHING DIE FOR MANUFACTURING SEAL MEMBER AND METHOD FOR MANUFACTURING SEAL MEMBER

(75) Inventor: Shiro Osumi, Takahama (JP)

(73) Assignee: IBIDEN Co., Ltd., Ogaki-shi (JP)

( * ) Notice: Subject to any disclaimer, the term of this patent is extended or adjusted under 35 U.S.C. 154(b) by 139 days.

(21) Appl. No.: 11/392,254

(22) Filed: Mar. 28, 2006

(65) Prior Publication Data

US 2007/0017328 A1 Jan. 25, 2007

(30) Foreign Application Priority Data

Jul. 19, 2005 (JP) ..... 2005-209137

(51) Int. Cl.
*B26D 3/00* (2006.01)
*B26D 1/12* (2006.01)
*B26D 1/00* (2006.01)

(52) U.S. Cl. ..... 83/39; 83/695; 83/678

(58) Field of Classification Search ..... 83/39, 49, 83/697, 695, 678
See application file for complete search history.

(56) References Cited

U.S. PATENT DOCUMENTS 1,177,005 A * 3/1916 Zimmerman ..... 83/652
3,182,530 A * 5/1965 Scott et al. ..... 76/107.8
3,263,547 A * 8/1966 Pfaff, Sr. et al. ..... 83/620
3,383,969 A * 5/1968 Saunders ..... 83/663
3,611,851 A * 10/1971 Lingofelt ..... 83/55
4,612,006 A 9/1986 Tokuno et al. ..... 493/342
4,665,779 A * 5/1987 Ratz ..... 76/107.1
4,856,393 A * 8/1989 Braddon ..... 83/50
5,129,295 A * 7/1992 Geffros et al. ..... 83/19
5,537,905 A * 7/1996 Zimmer et al. ..... 83/660
5,676,032 A * 10/1997 Johnson ..... 83/697
6,280,373 B1 8/2001 Lanvin
6,412,379 B1 7/2002 Turusaki ..... 83/155
2001/0046587 A1* 11/2001 Michael et al. ..... 428/137

(Continued)

FOREIGN PATENT DOCUMENTS

JP 48-74690 10/1973

(Continued)

OTHER PUBLICATIONS

Japanese Office Action for corresponding JP Application No. 2005-209137, Feb. 1, 2011.

*Primary Examiner* — Ghassem Alie
*Assistant Examiner* — Bharat C Patel
(74) *Attorney, Agent, or Firm* — Ditthavong Mori & Steiner, P.C.

(57) ABSTRACT

A punching die for punching out a seal member from a sheet of an inorganic fiber mat having a contour. The punching die includes a base plate. A first blade is supported on the base plate and has a cutting edge extending to form a loop. The first blade punches out a frame-shaped unnecessary portion, which includes the contour, and a seal member formation portion, which includes the seal member, from the inorganic fiber mat. A second blade, which is supported on the base plate at an outer side of the first blade, partially cuts the frame-shaped unnecessary portion. The at least one second blade forms a perforation in the frame-shaped unnecessary portion to separate the unnecessary portion into a plurality of unnecessary fragments. This improves productivity for production of the seal members.

12 Claims, 5 Drawing Sheets

U.S. PATENT DOCUMENTS

| | | | |
|---|---|---|---|
| 2007/0017327 | A1 | 1/2007 | Osumi |
| 2007/0017329 | A1 | 1/2007 | Osumi |
| 2007/0028744 | A1 | 2/2007 | Osumi |
| 2009/0072498 | A1 | 3/2009 | Tanahashi et al. |
| 2009/0075812 | A1 | 3/2009 | Tanahashi et al. |
| 2009/0081442 | A1 | 3/2009 | Tanahashi et al. |
| 2009/0143217 | A1 | 6/2009 | Tanahashi et al. |

FOREIGN PATENT DOCUMENTS

| | | | |
|---|---|---|---|
| JP | 57-166332 | | 10/1982 |
| JP | 01115594 | | 5/1989 |
| JP | 07102961 | | 4/1995 |
| JP | 07-299798 | | 11/1995 |
| JP | 11130342 | | 5/1999 |
| JP | 2001-316965 | | 11/2001 |
| JP | 2002-103239 | | 4/2002 |
| JP | 2002-349256 | | 12/2002 |
| JP | 2003-025291 | | 1/2003 |
| JP | 2004-300611 | | 10/2004 |
| KR | 10-2007-0011082 | | 1/2007 |
| TW | 200502072 | A | 1/2005 |
| WO | 9925964 | A | 5/1999 |

* cited by examiner

PUNCHING DIE FOR MANUFACTURING SEAL MEMBER AND METHOD FOR MANUFACTURING SEAL MEMBER

CROSS-REFERENCE TO RELATED APPLICATIONS

This application is based upon and claims the benefit of priority from prior Japanese Patent Application No. 2005-209137, filed on Jul. 19, 2005, the entire contents of which are incorporated herein by reference.

BACKGROUND OF THE INVENTION

The present invention relates to a punching die used in the manufacture of a seal member that is wound around an exhaust gas purifier, and a method for manufacturing a seal member using a punching die.

In the prior art, an exhaust gas purification apparatus includes a filter member for trapping particulate matter (PM) suspended in the exhaust gas, a casing for accommodating the filter member, and a sheet-like seal member arranged between the filter member and the casing. The seal member is wound around the filter member, and the filter member around which the seal member is wound, is pressed into the casing (refer to JP-A-2001-316965).

The seal member is required to have the properties described below. First, the seal member must have high heat resistance to withstand high-temperature exhaust gas. Next, the seal member must prevent leakage of exhaust gas from between the filter member and the casing. Further, the seal member must prevent the filter member from falling out of the casing or from moving in the casing.

The seal member may be manufactured by processing a sheet of inorganic fibers having a predetermined shape in accordance with the size and shape of the filter member. The manufacturing processes for the seal member may include a punching process for cutting a rolled mat of inorganic fibers to a predetermined length. The punching enables a plurality of seal members to be simultaneously produced. There is a demand for further improving the productivity of seal members.

SUMMARY OF THE INVENTION

One aspect of the present invention is a punching die for punching out a seal member from a sheet of an inorganic fiber mat having a contour. The punching die includes a base plate. A first blade is supported on the base plate and has a cutting edge extending to form a loop. The first blade punches out a frame-shaped unnecessary portion, which includes the contour of the inorganic fiber mat, and a seal member formation portion, which includes the seal member, from the inorganic fiber mat. At least one second blade, supported on the base plate at an outer side of the first blade, partially cuts the frame-shaped unnecessary portion. The at least one second blade forms a perforation in the frame-shaped unnecessary portion to divide the unnecessary portion into a plurality of unnecessary fragments.

Another aspect of the present invention is a method for manufacturing a seal member from a sheet of an inorganic fiber mat having a contour. The method includes forming a punching die by supporting a first blade on a base plate with the blade having a cutting edge extending to form a loop, and supporting at least one second blade on the base plate at an outer side of the first blade. The method further includes punching the inorganic fiber mat with the punching die by using the first blade to punch out a frame-shaped unnecessary portion, which includes the contour of the inorganic fiber mat, and a seal member formation portion, which includes the seal member, from the inorganic fiber mat, and using the least one second blade to partially cut the frame-shaped unnecessary portion and form perforations in the frame-shaped unnecessary portion to divide the unnecessary portion into a plurality of unnecessary fragments. The method also includes dividing the frame-shaped unnecessary portions into a plurality of unnecessary fragments at the perforations that are formed by the second blade, and removing the unnecessary fragments from the seal member formation portion.

In one embodiment, the at least one second blade has a non-continuous cutting edge including an edgeless portion.

In one embodiment, the edgeless portion is a notch.

In one embodiment, the notch has a width of about one to about eight millimeters.

In one embodiment, the edgeless portion does not cut the frame-shaped unnecessary portion.

In one embodiment, the at least one second blade is one of a plurality of spaced second blades for forming a plurality of perforations in the frame-shaped unnecessary portion.

In one embodiment, the first blade has a cutting edge that extends to form a rectangular frame having four corners, and the at least one second blade includes four second blades respectively extending outward from the four corners of the first blade.

In one embodiment, the second blade and the first blade forms a gap therebetween.

In one embodiment, the second blade and the first blade are spaced from each other by about one to about eight millimeters.

In one embodiment, the at least one second blade includes a plurality of spaced second blades for forming a plurality of perforations in the frame-shaped unnecessary portion.

In one embodiment, the first blade has a cutting edge that extends to form a rectangular frame having four corners, and the at least one second blade includes four second blades respectively arranged near the four corners of the first blade.

In one embodiment, the second blade is arranged inward from the contour of the inorganic fiber mat.

In one embodiment, the inorganic fiber mat includes an inner edge, and the second blade form a perforation connected to the inner edge.

In one embodiment, the at least one second blade includes a plurality of spaced second blades for forming a plurality of perforations in the frame-shaped unnecessary portion.

In one embodiment, the first blade has a cutting edge that extends to form a rectangular frame having four corners, and the at least one second blade includes four second blades respectively arranged near the four corners of the first blade.

In one embodiment, the punching die includes at least one third blade, supported on the base plate at an inner side of the first blade, for punching and separating the seal member formation portion into a plurality of seal members.

In one embodiment, each blade is made of carbon steel.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A punching die 11 according to a preferred embodiment of the present invention will now be described.

Figure 1A:
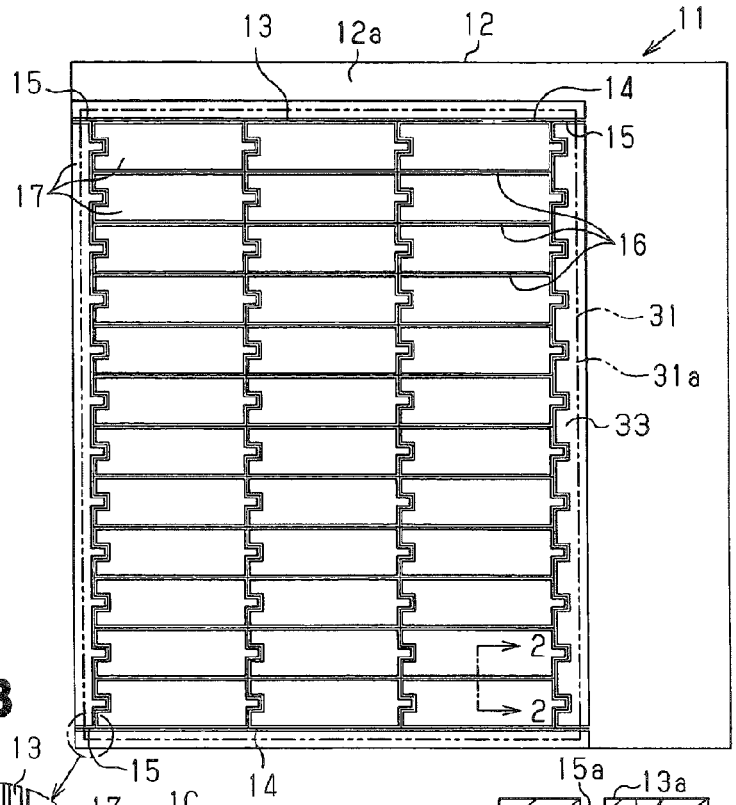
FIG. 1A is a plan view showing a punching die according to a preferred embodiment of the present invention.

As shown in FIG. 1A, the punching die 11 includes a base plate 12 and a plurality of blades 13 that are supported on the base plate 12. The punching die 11 is used to punch a sheet of an inorganic fiber mat 31 and cut out a seal member 34 from the inorganic fiber mat 31. The seal member 34 is wound around a filter member 42, which functions as an exhaust gas purifier (FIG. 5B). The punching die 11 of the preferred embodiment punches out a plurality of seal members 34 from the inorganic fiber mat 31.

The base plate 12 has a flat processing surface 12*a*. The processing surface 12*a* is rectangular and is larger than the inorganic fiber mat 31, which is rectangular. The base plate 12 may be made of any material but is preferably made of wood or plywood, which are easy to manufacture and have relatively high strengths.

The blades 13 include a first blade 14, at least one second blade 15, and at least one third blade 16. The first blade 14 has a cutting edge that projects from the processing surface 12*a* of the base plate 12 and extends in a loop or a rectangular circuit. The second blades 15 are arranged on the processing surface 12*a* at the outer side the first blade 14. The third blades 16 are arranged on the processing surface 12*a* at the inner side the first blade 14.

The cutting edge of the first blade 14 extends in the shape of a rectangular loop. The first blade 14 punches the inorganic fiber mat 31 to separate a frame-shaped unnecessary portion 33, which is the part of the inorganic fiber mat 31 including an outer end (contour) 31*a*, and a seal member formation portion 32, which is the part of the inorganic fiber mat 31 excluding the frame-shaped unnecessary portion 33. The punching with the first blade 14 forms the end surfaces of the seal member formation portion 32 and shapes the seal member formation portion 32.

The second blades 15 are continuously connected to the first blade 14 so that there is no gap between the second blades 15 and the first blade 14. Further, as shown in FIG. 1C, the second blades 15 each include a notch 15*a*. The notch 15*a* defines a non-continuous cutting edge 13*a*, which includes an edgeless portion that does not have any edge, and separates the second blades 15 from the first blade 14. The non-continuous cutting edge 13*a* of each second blade 15 forms a perforation in the frame-shaped unnecessary portion 33. The perforation includes an uncut connection part for weakly connecting the unnecessary fragments 33*a* of the unnecessary portion 33 to one another. The notches 15*a* of the second blades 15 do not cut the corresponding parts of the unnecessary portion 33.

Figure 1B:
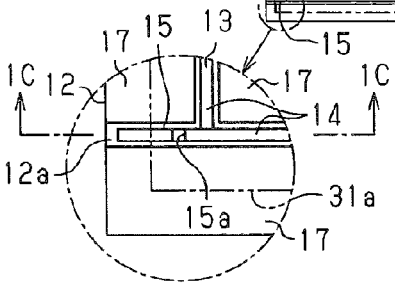
FIG. 1B is an enlarged view showing a corner of the punching die of FIG. 1A.
Figure 1C:
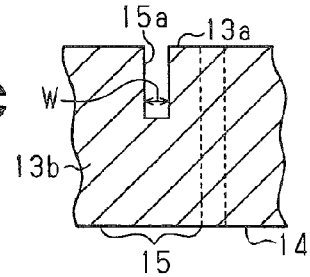
FIG. 1C is a partial cross-sectional view of the punching die shown in FIG. 1C taken along line 1C-1C.

Referring to FIG. 1B, it is preferred that the width W of the notch 15*a* be about one to about eight millimeters. This width range provides sufficient strength for maintaining the shape of the frame-shaped unnecessary portion 33, while forming uncut connection portions that weakly connect the unnecessary fragments 33*a*. The notches 15*a* have substantially the same width W. The second blades 15, which are spaced from one another, respectively extend outward from the four corners of the first blade 14. The first blade 14 separates the frame-shaped unnecessary portion 33 and the seal member formation portion 32. The seal member formation portion 32 is substantially rectangular and is surrounded by the frame-shaped unnecessary portion 33. The four second blades 15 forms at four corners of the frame-shaped unnecessary portion 33 four perforations that dividably connect four thin and elongated unnecessary fragments 33*a*.

The third blades 16 are arranged at the inner side of the first blade 14. The third blades 16 punch the seal member formation portion 32 and divide the seal member formation portion 32 into a plurality of seal members 34. In the preferred embodiment, the plurality of third blades 16 are arranged in a grid. With such third blades 16, a single punching operation enables the plurality of seal members 34 to be cut out of the single inorganic fiber mat 31.

Figure 2:
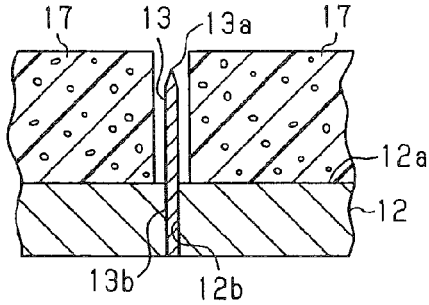
FIG. 2 is a partial cross-sectional view of the punching die shown in FIG. 1C taken along line 2-2 of FIG. 1A.

As shown in FIG. 2, the base plate 12 includes mounting grooves 12*b*. The mounting grooves 12*b* are formed in the processing surface 12*a*, for example, through laser processing. Basal portions 13*b* of the blades 13 (14, 15, and 16) are pressed into the mounting grooves 12*b* so that the cutting edges 13*a* of the blades 13 project from the processing surface 12*a*. The blades 13 are supported on the base plate 12 in this manner. The cutting edges 13*a* of the blades 13 are aligned at a predetermined height from the processing surface 12*a*.

The blades 13 are fixed to the base plate 12 in a predetermined arrangement. Each blade 13 may be formed by bending a single thin and elongated blade in a predetermined manner and fixing the blade to the base plate 12. Alternatively, the blades 13 may be formed by arranging a plurality of blade pieces adjacent to one another in a continuous manner and fixing the blade pieces to the base plate 12. The blades 13 may be formed, for example, from a metal material or a ceramic material. In the preferred embodiment, the blades 13 are made of carbon steel, which easily bends. Each blade 13 may be single edged or double edged. In the example of FIG. 2, the blade 13 is double edged. It is preferable that the blade 13 be double edged to reduce resistance when punching the inorganic fiber mat 31. Although not limited, the blade 13 has a thickness in the range of about 0.5 to about 1.5 mm. In the preferred embodiment, the blade 13 has a thickness of approximately 1 mm.

As shown in FIGS. 1 and 2, a foam layer 17 is fixed on the processing surface 12*a* in an area defined by the first blade 14 and the third blades 16 and an area outside the first blade 14.

Figure 3A:
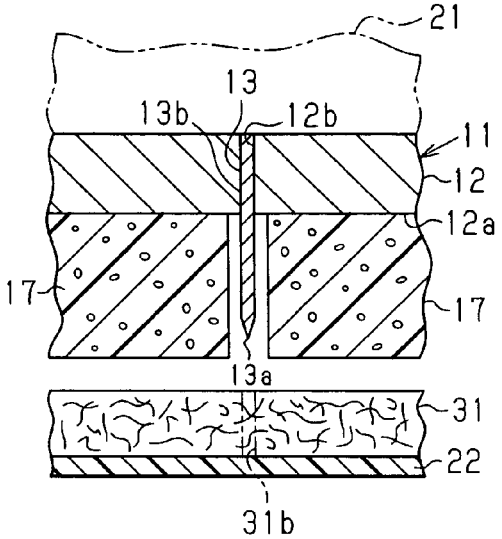
FIGS. 3A and 3B are cross-sectional views showing how an inorganic fiber mat is punched with the punching die of FIG. 1A.
Figure 3B:
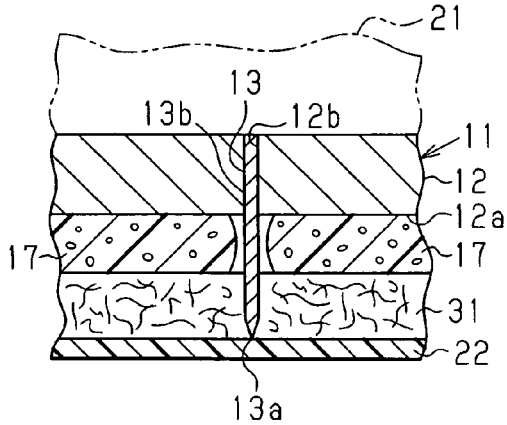

The operation of the foam layer 17 will now be described. As shown in FIG. 3A, the punching die 11 is set in a press 21 with the processing surface 12*a* facing downwards. The inorganic fiber mat 31 is placed on a conveyer or a processing plate 22 arranged below the punching die 11. When the press 21 is driven, the blades 13 penetrate the surface of the inorganic fiber mat 31 at a right angle and are moved downward until their cutting edges come into contact with the processing plate 22. As a result, the blades 13 cut the inorganic fiber mat 31. Referring to FIG. 3B, the pressure applied by the press 21 compresses and elastically deforms the foam layer 17. The repulsive force of the foam layer 17 acts on the inorganic fiber mat 31. When the press 21 moves upward, the repulsive force of the foam layer 17 downwardly presses the inorganic fiber mat 31. As a result, the cutting edges 13*a* are removed from the punched inorganic fiber mat 31. FIG. 3A shows a cut surface 31*b* of the punched inorganic fiber mat 31. The foam layer 17 separates the punched inorganic fiber mat 31 from the punching die 11. In this state, the punched inorganic fiber mat 31 is conveyed to a workbench.

It is preferable that a gap be formed between the foam layer 17 and the blades 13. The gap reduces friction resistance between the inorganic fiber mat 31 and the blades 13 when the foam layer 17 presses the inorganic fiber mat 31. It is preferable that the gap between the foam layer 17 and the blades 13 be about 10 mm or less. When the gap is about 10 mm or less, the inorganic fiber mat 31 does not get caught between the foam layer 17 and the blades 13. This prevents deformed seal members from being manufactured.

The foam layer 17 is manufactured from an elastic material that produces sufficient repulsive force for removing the cutting edges 13*a* from the inorganic fiber mat 31. The preferred material for the foam layer 17 is synthetic rubber since this material maintains repulsive force (the foam layer 17 does not become flat) even after repetitive use of the punching die 11.

Referring to FIG. 3A, in a state in which the foam layer 17 is not compressed, it is preferred that the thickness of the foam layer 17 be greater than the height of the cutting edges 13*a* from the processing surface 12*a*. In this case, the foam layer 17 presses the inorganic fiber mat 31 to a location below the cutting edges 13*a* so that the inorganic fiber mat 31 is easily separated from the punching die 11. The foam layer 17 is fixed to the processing surface 12*a* by a double-sided tape or an adhesive.

Preferable materials for the inorganic fiber mat 31 include inorganic fibers, such as silica fibers, alumina fibers, and silica-alumina fibers. The inorganic fiber mat 31 is obtained by forming a sheet of inorganic fibers. The inorganic fiber mat 31 may be obtained by cutting a rolled mat of inorganic fibers to a predetermined length. The thickness of the inorganic fiber mat 31 may be, for example, about 5 to about 10 mm. It is preferred that the inorganic fiber mat 31 be needle-punched. A seal member 34 cut out of a needle-punched inorganic fiber mat 31 has a reduced thickness and exhibits satisfactory seal performance. The inorganic fiber mat 31 may be impregnated with a binder resin so that a seal member 34 would have reduced thickness and exhibit satisfactory seal performance. Further, the binder resin prevents inorganic fibers from falling off from the inorganic fiber mat 31 or from the seal member 34.

Figure 4:
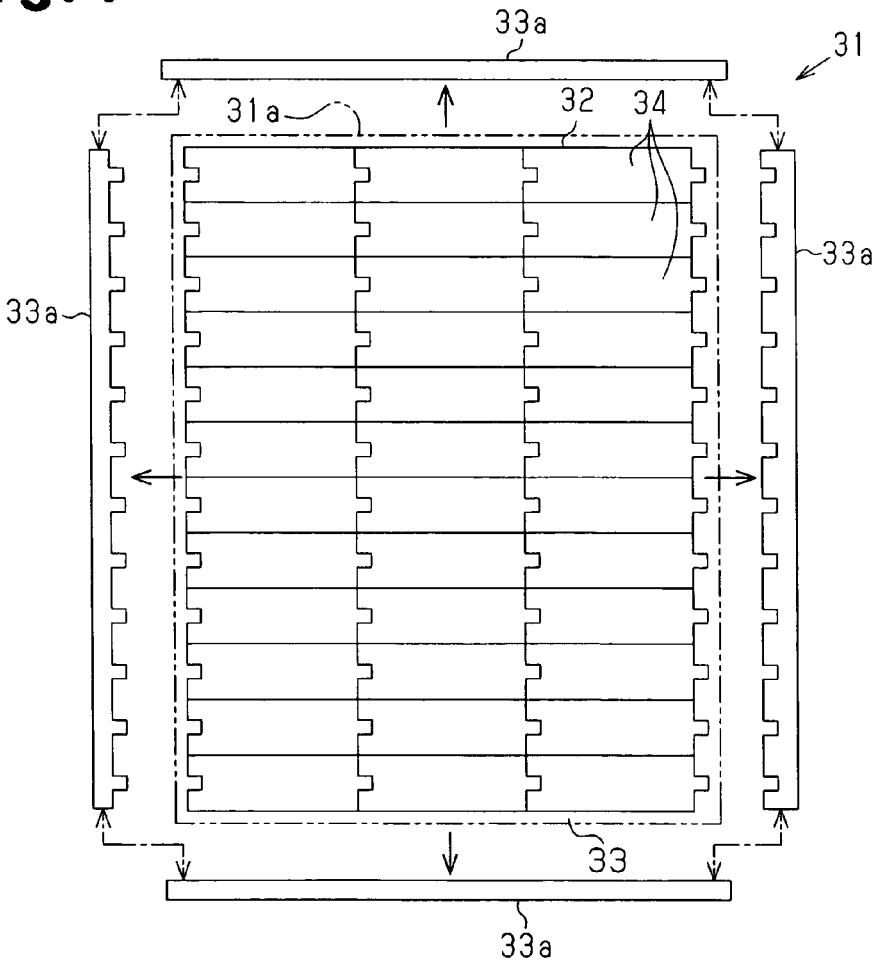
FIG. 4 is a plan view showing seal members and unnecessary fragments that are punched out with the punching die of FIG. 1A.

As shown in FIG. 4, the inorganic fiber mat 31 is punched by the first blade 14 and divided into the seal member formation portion 32 and the frame-shaped unnecessary portion 33. The seal member formation portion 32 is punched by the third blades 16 and divided into the seal members 34.

The second blades 15 cut the frame-shaped unnecessary portion 33 to form perforations for dividing the frame-shaped unnecessary portion 33 into the unnecessary fragments 33*a*. The unnecessary fragments 33*a* can easily be separated from one another at the perforations. However, the unnecessary portion 33 still has a frame-shape when punched out. Accordingly, the punched out inorganic fiber mat 31 may be transported in a state in which the weakly connected unnecessary fragments 33*a* surround the seal member 34. Referring to FIG. 4, the perforations are torn to separate the four unnecessary fragments 33*a*. The separated unnecessary fragments 33*a* can be removed by moving them aside from the seal member formation portion 32 on the workbench. The removed unnecessary fragments 33*a* are then collected.

After the unnecessary fragments 33*a* are removed, only the seal members 34 remain on the workbench. Thus, the seal members 34 can be readily collected. The collected seal members 34 are placed in a transportation container and transported for assembly of an exhaust gas purification apparatus.

Figure 5A:
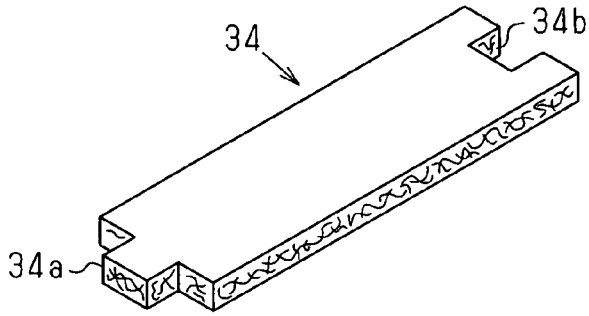
FIG. 5A is a perspective view showing a seal member.
Figure 5B:
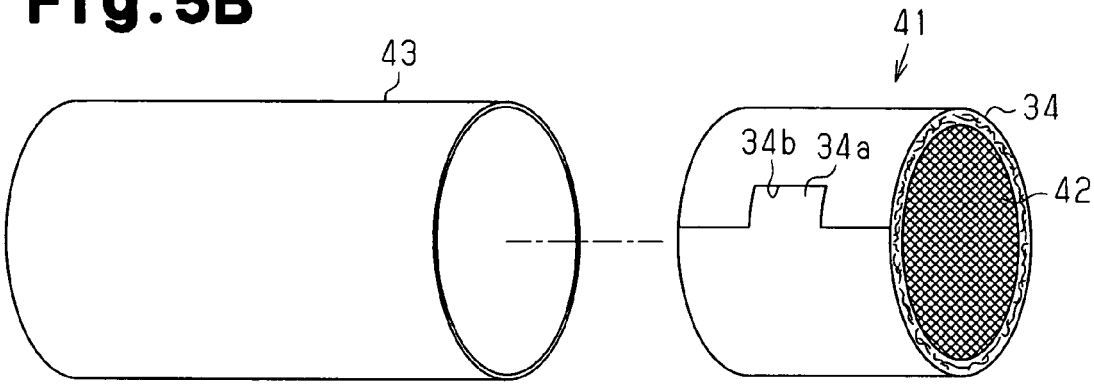
FIG. 5B is a perspective view showing a seal member that is wound around an exhaust gas purifier and a casing for accommodating the exhaust gas purifier.

FIG. 5A shows one example of a seal member 34. The seal member 34 is rectangular and includes a tab 34*a* and a recess or socket 34*b*. When the seal member 34 is wound around an exhaust gas purifier, the tab 34*a* is fitted in the socket 34*b*.

An exhaust gas purification apparatus 41 will now be described with reference to FIG. 5B. The exhaust gas purification apparatus 41 includes a filter member 42, which functions as an exhaust gas purifier, a casing 43, and a seal member 34. The seal member 34 is arranged between the filter member 42 and the casing 43, which accommodates the filter member 42. In one example, the filter member 42 is a cylindrical honeycomb structure having a large number of cells. When the exhaust gas passes through the filter member 42, the particulate matter suspended in the exhaust gas is trapped by the inner walls of the cells. The filter member 42 may be made of a ceramic, such as silicon carbide, silicon nitride, cordierite, or mullite. The filter member 42 may be a catalyst carrier for carrying a catalyst.

The casing 43 is a cylinder having an inner diameter slightly larger than the outer diameter of the filter member 42. In one example, the casing 43 is made of metal.

The assembly of the exhaust gas purification apparatus 41 will now be described. First, the seal member 34 is wound around the filter member 42. The tab 34*a* is fitted into the socket 34*b*. Thus, the seal member 34 is wound around the entire circumference of the filter member 42 without its ends overlapping each other.

The filter member 42 around which the seal member 34 is wound is pressed into the casing 43. The seal member 34 is elastically compressed. The repulsive force of the seal member 34 fixes the filter member 42 in the casing 43. The seal member 34 functions as a protective cushion for preventing the filter member 42 from hitting the casing 43 due to vibrations transmitted from the outer side.

Figure 6:
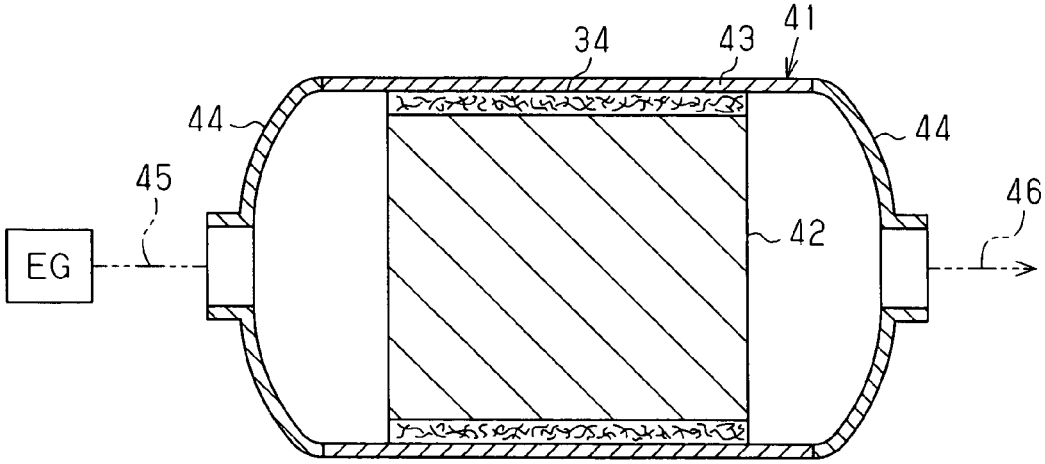
FIG. 6 is a cross-sectional view of an exhaust gas purification apparatus.

As shown in FIG. 6, a coupler 44 is connected to each of the two open ends of the casing 43 in the exhaust gas purification apparatus 41, for example, through welding. The coupler 44 on one end of the casing 43 is connected to a first exhaust pipe 45, which is further connected to a vehicle engine. The coupler 44 on the other end of the casing 43 is connected to a second exhaust pipe 46, which is further connected to a muffler (not shown). Exhaust gas is emitted from the engine via the exhaust gas purification apparatus 41.

The seal member 34 seals the gap between the outer circumferential surface of the filter member 42 and the inner circumferential surface of the casing 43 to prevent exhaust gas from leaking out from between the outer circumferential surface of the filter member 42 and the inner circumferential surface of the casing 43.

The preferred embodiment has the advantages described below.

(1) The first blade 14 punches out the frame-shaped unnecessary portion 33. The second blades 15 form the perforations on the frame-shaped unnecessary portion 33 but do not separate the unnecessary portion 33 into the unnecessary fragments 33*a*. Thus, the unnecessary portion 33 remains frame-shaped. Accordingly, when the punched inorganic fiber mat 31 is transported, the seal members 34 are transported in a state surrounded by the unnecessary portion 33. Further, after transporting the punched inorganic fiber mat 31 to the workbench in order to collect the seal members 34, the unnecessary portion 33 is still frame-shaped. This prevents the unnecessary fragments 33*a* from mixing with the seal members 34. Thus, the perforations of the frame-shaped unnecessary portion 33 may be torn to separate the unnecessary fragments 33*a* from each other and smoothly remove the unnecessary fragments 33*a* from the seal members 34. In this manner, the unnecessary portion 33 and the seal members 34 do not become scattered. Thus, the unnecessary fragments 33*a* and the seal members 34 do not have to be separately sorted out, and the unnecessary portion 33 may be removed smoothly. This improves efficiency for removing the unnecessary portion 33. The blades 13, which include the second blades 15, are received in the mounting grooves 12*b*. The mounting of the blades 13 is simple and thus does not complicate the manufacturing of the punching die 11.

(2) It is preferred that the notch 15*a* of each second blade 15 have a width W of about one to about eight millimeters. In this case, the second blades 15 form perforations having an appropriate strength. Therefore, during transportation of the punched inorganic fiber mat 31, the frame-shaped unnecessary portion 33 is not torn apart at the perforations. Further, after transporting the punched inorganic fiber mat 31, the frame-shaped unnecessary portion 33 may be separated into the fragments 33*a* at the perforations.

(3) The second blades 15, which are spaced from one another, form the perforations enabling the frame-shaped unnecessary portion 33 to be separated into the unnecessary fragments 33*a*. In comparison with the unnecessary portion 33, the relatively small unnecessary fragments 33*a* are less apt to clinging to the seal members 34. This facilitates removal of the unnecessary fragments 33*a*. Further, when removing the unnecessary fragments 33*a*, burrs do not form on the seal members 34.

(4) The cutting edge of the first blade 14, which extends in the shape of a rectangular loop, cuts out the rectangular frame-shaped unnecessary portion 33. The cutting edges of the second blades 15 extend outward from the corners of the first blade 14 and form perforations to separate the rectangular frame-shaped unnecessary portion 33 into the thin and elongated unnecessary fragments 33*a*. The unnecessary fragments 33*a*, which are torn apart at the perforation, are outwardly moved away from the seal member formation portion 32 and easily removed from the seal member formation portion 32. The rectangular frame-shaped unnecessary portion 33 is separated into the linear unnecessary fragments 33*a*. Thus, arrangement of the removed unnecessary fragments 33*a* in a parallel state at a temporary collection spot reduces space occupied by the removed unnecessary fragments 33*a*.

(5) The third blades 16 that separate the seal member formation portion 32 into the plurality of seal members 34 are arranged at the inner side the first blade 14. A single punching operation forms the seal members 34 from the single inorganic fiber mat 31. This improves operation efficiency for removing the unnecessary portion 33 and increases the productivity of the seal members 34.

(6) The punching die 11 manufactures the seal members 34 from the inorganic fiber mat 31 with high productivity.

(7) When the inorganic fiber mat 31 is cut out of a rolled inorganic fiber mat or a long inorganic fiber mat, the end surfaces of the roll or the cut surfaces of the long inorganic fiber mat become the outer end 31*a* of the inorganic fiber mat 31. In this case, the outer end 31*a* of the inorganic fiber mat 31 may have an uneven thickness. Accordingly, the first blade 14 punches out the frame-shaped unnecessary portion 33 including the outer end 31*a* and shapes the inorganic fiber mat 31.

The second blades 15 form the perforations for partially separating the frame-shaped unnecessary portion 33 into the unnecessary fragments 33*a*. After transporting the inorganic fiber mat 31, the frame-shaped unnecessary portion 33 is torn up into the unnecessary fragments 33*a* at the perforations (uncut connection parts). Thus, the cut surfaces of the seal member formation portion 32 (end surfaces of the seal members 34) will not have burrs when the unnecessary fragments 33*a* are separated from the seal member formation portion 32. This results in seal members 34 with high-quality, uniform thickness, and uniform shape.

It should be apparent to those skilled in the art that the present invention may be embodied in many other specific forms without departing from the spirit or scope of the invention. Particularly, it should be understood that the present invention may be embodied in the following forms.

The notch 15*a* of each second blade 15 may be in any quantity. Thus, each second blade 15 may have one or more notches 15*a*. For example, as shown in the embodiments of FIGS. 1A and 1B and FIGS. 7A and 7B, each second blade 15 includes only one notch 15*a*.

Figure 7A:
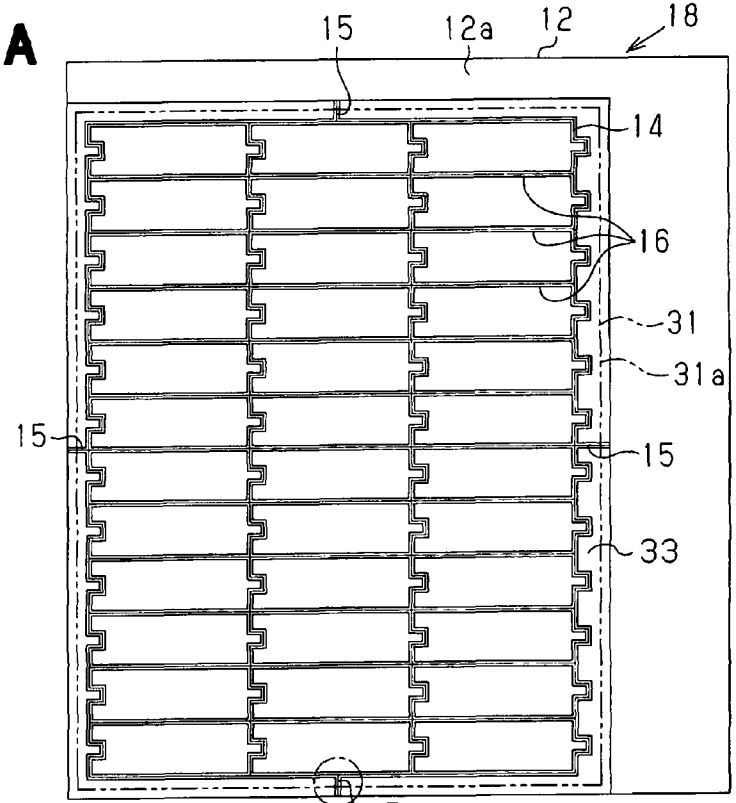
FIG. 7A is a plan view showing a first modification of a punching die according to the present invention.
Figure 7B:
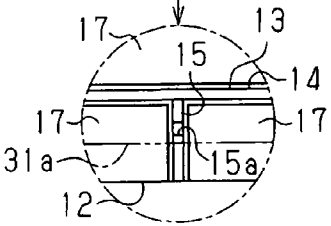
FIG. 7B is a partially enlarged view showing the punching die of FIG. 7A.
Figure 8:
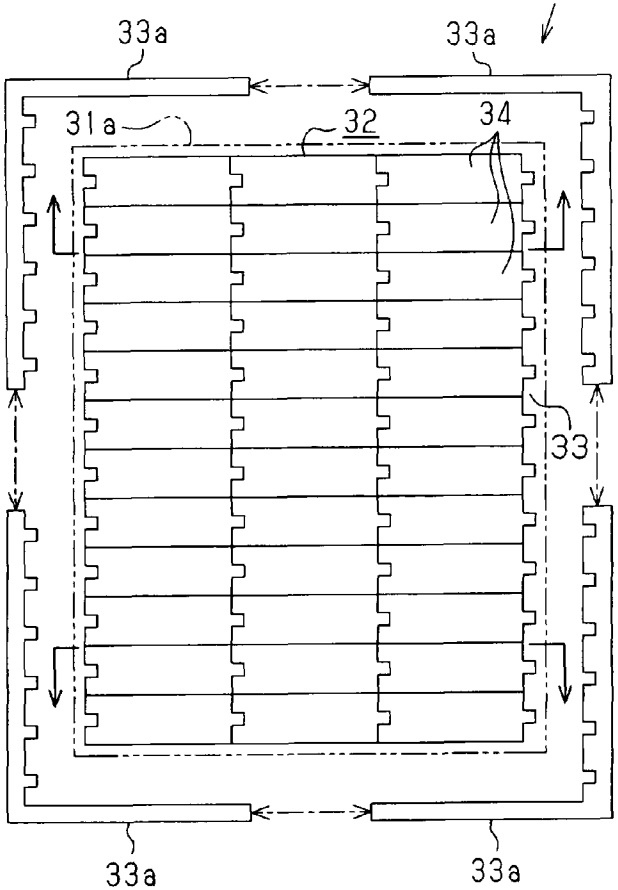
FIG. 8 is a plan view showing seal members and unnecessary fragments that are punched out using the punching die of FIG. 7A.

The positions of the second blades 15 may be changed. As shown in FIGS. 7A and 7B, a punching die 18 may include a plurality of second blades 15, which extend outward from the rectangular loop-shaped first blade 14 at locations other than the four corners. As shown in FIG. 8, an unnecessary portion 33 of an inorganic fiber mat 31, which is punched using the punching die 18, is separated into four L-shaped unnecessary fragments 33*a*.

Figure 9A:
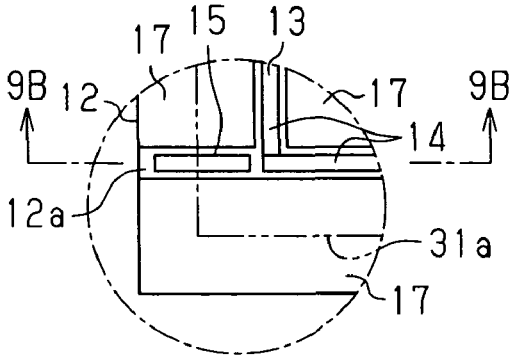
FIG. 9A is a plan view showing a second modification of a punching die according to the present invention.
Figure 9B:
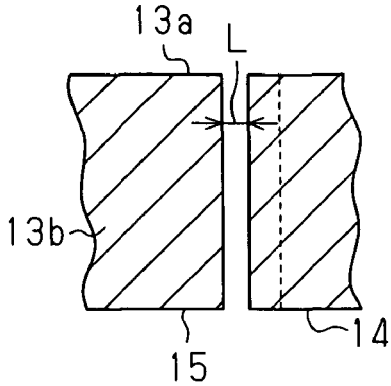
FIG. 9B is a partial cross-sectional view taken along line 9B-9B of FIG. 9A.

The notches 15*a* of the second blades 15 may be eliminated. In the example shown in FIGS. 9A and 9B, each second blade 15 has a continuous cutting edge and is spaced from the first blade 14. Thus, a gap, which defines a portion that does not include a blade, is formed between the second blade 15 and the first blade 14. The second blade 15 partially punches out the frame-shaped unnecessary portion 33 to form a perforation connected to the outer end of the frame-shaped unnecessary portion 33. An uncut connection part is formed on the inner edge (inner contour) of the unnecessary portion 33. In this case, the same advantages as the previously described preferred embodiment are obtained.

It is preferred that the distance L between the first blade 14 and each second blade 15 be about one to about eight millimeters. This width range provides sufficient strength for maintaining the shape of the frame-shaped unnecessary portion 33, while forming perforations for enabling easy separation of the unnecessary fragments 33*a* from the unnecessary portion 33.

Figure 10A:
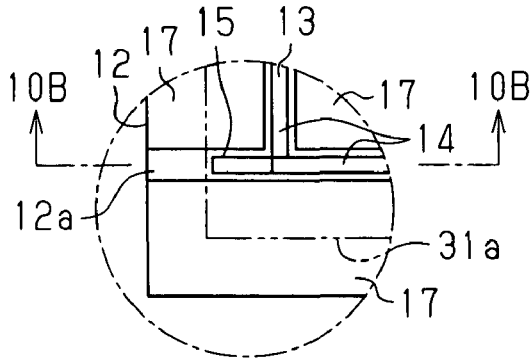
FIG. 10A is a plan view showing a third modification of a punching die according to the present invention.
Figure 10B:
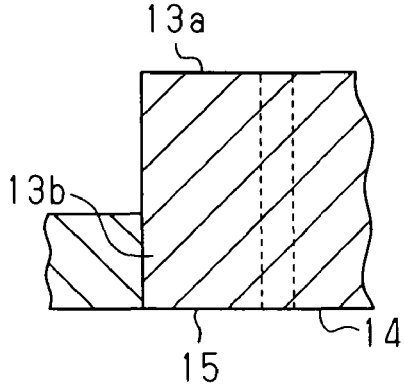
FIG. 10B is a partial cross-sectional view taken along line 10B-10B of FIG. 10A.

The notches 15*a* of the second blades 15 may be eliminated. In the example shown in FIGS. 10A and 10B, each relatively short second blade 15, which has a continuous cutting edge, extends outward from the first blade 14. The second blade 15 has an outer end located inward from the outer end 31*a* of the inorganic fiber mat 31. The second blade 15 partially punches out the frame-shaped unnecessary portion 33 to form a perforation connected to the inner edge of the frame-shaped unnecessary portion 33. An uncut connection part is formed on the outer end of the unnecessary portion 33. In this case, the same advantages as the previously described preferred embodiment are obtained.

The first blade 14 may be arranged to form a closed loop other than a rectangular loop. For example, the first blade 14 may be arranged to form a hexagonal loop. However, when the inorganic fiber mat 31 is rectangular, the number of seal members 34 cut out of the inorganic fiber mat 31 can be maximized, and the unnecessary portion 33 may be minimized. Accordingly, it is preferred that the first blade 14 be arranged to form a rectangular frame.

The inorganic fiber mat 31 does not have to be rectangular and may have other shapes. For example, the inorganic fiber mat 31 may be hexagonal.

The base plate 12 does not have to be rectangular and may have any other shape in accordance with the shape of the inorganic fiber mat 31. For example, the base plate 12 may be hexagonal.

The quantity of the second blades 15 may be only one. Alternatively, the quantity of the second blades 15 may be three or less or five or more.

The size and the shape of the seal member 34 differ depending on the size and the shape of the filter member 42. Thus, the arrangement of the third blades 16 may be changed in accordance with the size and shape of the filter member 42.

The seal member 34 does not have to include the tab 34*a* and the socket 34*b*.

The third blades 16 may be eliminated. In this case, the punching die 11 punches a single seal member 34 out of a sheet of an inorganic fiber mat 31.

The punching die 11 does not have to include the foam layer 17.

The contents of JP-A-2001-316965 are incorporated herein by reference.

The present examples and embodiments are to be considered as illustrative and not restrictive, and the invention is not to be limited to the details given herein, but may be modified within the scope and equivalence of the appended claims.

What is claimed is:

1. A method comprising:

manufacturing a plurality of seal members for winding around an exhaust gas purifier body from a sheet of an inorganic fiber mat having a contour, wherein the manufacturing comprises:

forming a punching die by supporting a first blade on a base plate with the first blade having a cutting edge extending to form a loop, and supporting a plurality of second blades on the base plate at an outer side of the first blade, wherein each second blade includes only one notch having a substantially constant width;

punching the inorganic fiber mat with the punching die by using the first blade to punch out a frame-shaped unnecessary portion, which includes the contour of the inorganic fiber mat, and a seal member formation portion, from which only the plurality of seal members are obtained and which is surrounded by the frame-shaped unnecessary portion, from the inorganic fiber mat, and using the plurality of second blades to form perforations in the frame-shaped unnecessary portion, the perforations each extending from an inner edge to an outer edge of the frame-shaped unnecessary portion and including a cut part that is cut by the second blade and an uncut connection part that is not cut by the notch of the second blade for tearably connecting linear-shaped or L-shaped unnecessary fragments of the frame-shaped unnecessary portion to one another, wherein the cut part of the perforation is formed at least at the outer edge of the frame-shaped unnecessary portion, the uncut connection part of the perforation is not formed at least at the outer edge of the frame-shaped unnecessary portion, and neither the first blade nor the second blade are arranged at the location corresponding to the uncut connection part of the perforation;

tearing up the uncut connection parts to divide the perforated frame-shaped unnecessary portion into a plurality of linear-shaped or L-shaped unnecessary fragments; and removing the linear-shaped or L-shaped unnecessary fragments from the seal member formation portion.

2. The method according to claim 1, wherein the uncut connection part has a length of about one to about eight millimeters.

3. The method according to claim 1, wherein the plurality of second blades are arranged inward from the contour of the inorganic fiber mat.

4. The method according to claim 3, wherein the inorganic fiber mat includes an inner edge, and the each second blade forms the cut part at the inner edge.

5. The method according to claim 3, wherein the first blade has a cutting edge that extends to form a rectangular frame having four corners, and the plurality of second blades are four second blades respectively arranged near the four corners of the first blade.

6. The method according to claim 1, wherein each blade is made of carbon steel.

7. The method according to claim 1, wherein said punching forms no unnecessary portion within the seal member formation portion.

8. The method according to claim 1, wherein the first blade has a cutting edge that extends to form a rectangular frame having four corners, and the plurality of second blades includes four second blades respectively extending outward from the four corners of the first blade.

9. The method according to claim 1, wherein the punching die further includes at least one third blade, supported on the base plate at an inner side of the first blade, for punching and separating the seal member formation portion into a plurality of seal members.

10. A method comprising:

manufacturing a plurality of seal members for winding around an exhaust gas purifier body from a sheet of an inorganic fiber mat having a contour, wherein the manufacturing comprises:

forming a punching die by supporting a first blade on a base plate with the first blade having a cutting edge extending to form an enclosed loop, and supporting a plurality of second blades on the base plate at a location outside of the enclosed loop on an outer side of the first blade, wherein each second blade includes only one notch having a substantially constant width;

punching the inorganic fiber mat with the punching die by using the first blade to punch a seal member formation portion defined by the enclosed loop and a frame-shaped unnecessary portion that completely encircles the seal member formation portion, and using the plurality of second blades to form perforations in the frame-shaped unnecessary portion, the perforations each extending from an inner edge to an outer edge of the frame-shaped unnecessary portion and including a cut part that is cut by the second blade and an uncut connection part that is not cut by the notch of the second blade for tearably connecting unnecessary fragments of the frame-shaped unnecessary portion to one another, wherein the cut part of the perforation is formed at least at the outer edge of the frame-shaped unnecessary portion, the uncut connection part of the perforation is not formed at least at the outer edge of the frame-shaped unnecessary portion, and neither the first blade nor the second blade are arranged at the location corresponding to the uncut connection part of the perforation;

tearing up the uncut connection parts to divide the perforated frame-shaped unnecessary portion into a plurality of unnecessary fragments; and removing the unnecessary fragments from the seal member formation portion.

11. The method according to claim 1, wherein each notch on each second blade has substantially a same width.

12. The method according to claim 10, wherein each notch on each second blade has substantially a same width.

* * * * *